US007026926B1

(12) United States Patent
Walker, III

(10) Patent No.: US 7,026,926 B1
(45) Date of Patent: Apr. 11, 2006

(54) SYSTEM AND METHOD FOR WIRELESS TRANSMISSION OF SECURITY ALARMS TO SELECTED GROUPS

(76) Inventor: Ethan A. Walker, III, 203 Red Oak La., Newalla, OK (US) 74857

( * ) Notice: Subject to any disclaimer, the term of this patent is extended or adjusted under 35 U.S.C. 154(b) by 68 days.

(21) Appl. No.: 10/636,350

(22) Filed: Aug. 7, 2003

Related U.S. Application Data

(60) Provisional application No. 60/403,740, filed on Aug. 15, 2002.

(51) Int. Cl.
*G08B 1/08* (2006.01)

(52) U.S. Cl. ..... 340/539.11; 340/506; 340/541; 379/37

(58) Field of Classification Search ..... 340/539.11, 340/539.16, 502, 506, 541, 7.61, 7.62, 10.52; 379/37, 41, 44; 455/404.1, 414.4; 713/201
See application file for complete search history.

(56) References Cited

U.S. PATENT DOCUMENTS 5,278,539 A 1/1994 Lauterbach et al. ..... 340/539
5,534,851 A * 7/1996 Russek ..... 340/573.4
5,566,339 A * 10/1996 Perholtz et al. ..... 713/340
5,689,235 A * 11/1997 Sugimoto et al. ..... 340/541
5,748,083 A 5/1998 Rietkerk ..... 340/568
6,049,272 A 4/2000 Lee et al. ..... 340/539
6,088,455 A * 7/2000 Logan et al. ..... 380/200
6,288,644 B1 9/2001 Mathews et al. ..... 340/555
6,359,557 B1 * 3/2002 Bilder ..... 340/531
6,553,100 B1 * 4/2003 Chen et al. ..... 379/37

* cited by examiner

*Primary Examiner*—Phung T. Nguyen
(74) *Attorney, Agent, or Firm*—James F. Harvey, III

(57) ABSTRACT

Systems, apparatus, methods, and computer program products for a security system to automatically notify by wireless communications means selected classes of recipients of the occurrence an alarm event, receiving acknowledgment of the receipt of the alert by the recipient, receiving either a digital or a vocal message, and responding appropriately to the reception. The recipients may be provided with handheld transceivers that have been assigned to one of a plurality of communications channels. The system includes a communications interface that allows a central computer, in response to an alarm, to locate a communications channel and message text for transmission to a selected group of recipients. The computer system may then programmatically select the communications channel, convert the message text into an audio, synthesized voice message, and send the message to the recipients on the selected communications channel. The recipients may respond to the message with a code entered on a keypad of their handheld transceivers.

22 Claims, 6 Drawing Sheets

SYSTEM AND METHOD FOR WIRELESS TRANSMISSION OF SECURITY ALARMS TO SELECTED GROUPS

CROSS-REFERENCES TO RELATED APPLICATIONS

The present patent application claims the benefit of the filing date of U.S. Provisional Patent Application No. 60/403,740, filed Aug. 15, 2002, and entitled "Method and Apparatus for Wireless Transmission of Security Alarms to Selected Groups."

FIELD OF THE INVENTION

The present invention relates to an emergency security alerting system and deals more particularly with methods, systems, hardware, and computer program products to automatically alert selected classes of people in the event of the occurrence of an emergency.

BACKGROUND OF THE INVENTION

In commercial business situations, security systems are commonly employed to monitor and protect property, as schematically shown in FIG. 1. Various threats may be of interest, and these threats may be either natural or human-related. Natural threats would include such conditions as the presence of fire, excess water where it is not desired, over-temperature alarms in refrigeration equipment, under-temperature alarms, and such. Human-related threats would include such conditions as unauthorized entry to a given area, removal of equipment from a specified area, nuclear, biological, or chemical attack; and the like. Security systems typically employ sensors to detect a condition related to the threat. For example, to detect the presence of a fire, a fire alarm sensor would be installed in the specified area to detect an elevated temperature condition. The sensor, upon detecting the heat from fire, would send an alert indication to a central facility, typically a computer system, which would record the detected condition as an event.

When the event is recorded, then it must be evaluated to determine what appropriate action to take place. Occasionally the event is ignored, as for example, when a door having a sensor is opened during normal business hours. After hours, however, the computer system may generate an alarm. Other events, such as an over-temperature alert indicating a fire, may always generate an alarm. The alarm may be some physical manifestation such as a rotating light, an audible sound, or both. The alarm may also be a notification of the event sent to an interested recipient so that the recipient can take some action. The physical manifestation may itself serve as notification. Typically, however, the recipient may receive notification by some telephonic means such as telephone (via dedicated line or switched network), pager, cellular phone, or radio.

Many different types and configurations of security systems have been proposed to deal with this process. U.S. Pat. No. 5,278,539, issued Jan. 11, 1994, to Lauterbach et al., describes an emergency alerting system in which an alarm is transmitted to an automated controller for a radio transmitter. The transmitter may be part of an existing radio paging system. The receiving unit transmits an acknowledgment back to the sending unit.

U.S. Pat. No. 4,956,875, issued Sep. 11, 1990, to Bernard et al., discloses an FM transmitter having first and second encoding means, the first encoding means which enables the selection of all receivers in a given location, and the second encoding means which enables a broadcast to particular receivers in the selected location. The FM receivers are receptive but inactive until the encoded signal specific to that receiver is received; the fully activated receiver then sounds an audible alarm to alert and notify persons in the vicinity.

U.S. Pat. No. 6,288,644, issued Sep. 11, 2001, to Matthews et al., discloses a perimeter alarm sensing means for detecting intrusion into the secure space and peripherally discusses transmission of an alarm to a recipient. The system includes a first and a second mounting apparatus, a reflector assembly, a monitor, a receiver, and an alarm for a timing device.

U.S. Pat. No. 6,049,272, issued Apr. 11, 2000, to Lee et al., discloses an automated data transmission system for sending alarms directly to law enforcement or security personnel. The system uses various means of communications, including phone line, pager, and wireless transmitters. The choice of communications channel is made at the telephone company and not necessarily at the host security computer.

Security system configurations are complicated by the need to classify the events on the basis of need-to-know, to send alarms and notifications only to those recipients that are have an interest in the alert condition generating the alarm, and to facilitate interaction between the security facility and the alarm recipient. Concerning classification of events based on a need-to-know, different alarms are of interest to different recipients or groups of recipients. For example, a fire alarm condition would be of interest to the fire station and to the owner of the business from which the fire alarm originated, but not to every worker employed by the business. An unauthorized open door alarm would be of interest to law enforcement personnel and to the owners of the business, but not to fire department personnel. Conditions in one building of a multi-building complex would be of interest only to the security personnel having responsibility for that building, and then only to those on duty at the time of the occurrence of the condition, but not to security personnel assigned to adjacent buildings.

Once the alert is detected, evaluated, and the appropriate recipients identified, then some means must be employed to send notification of the alert to just those recipients having an interest in the particular threat condition and not to others, so as not to overburden all personnel by requiring them to differentiate between alerts of interest and those which are of no interest. It would be desirable to partition the recipients into groups based upon different criteria, i.e. association with the particular alarm, the type of alarm (e.g. fire, open door, particular building, etc.), or an organizational unit.

When the recipient receives the notification, then there should be some interactive mechanism to allow the recipient to respond. The central facility generating the notification should know that the appropriate recipient received the alarm notification, so there must be a means for the recipient to acknowledge its receipt. Furthermore, the central facility should be sure that the recipient responding to the alarm is authorized to act, so that there should be some kind of authentication capability which allows the recipient to identify himself. Finally, if the recipient fails to respond, the central facility should have the means of identifying an alternate recipient, sending the notification to the alternate recipient, and logging the fact that the original recipient did not respond, in order to support further investigation by the managers, if necessary.

As with any complicated system, equipment may malfunction. In a security system, it is desirable to determine whether the failure of a recipient to respond to a notification is due to the fact that the recipient is unavailable or that the recipient did not receive the notification because of equipment failure. Such information would allow the security system to self-generate an alarm for its own equipment failure and to summon maintenance personnel to deal with the outage.

It can therefore be seen that there is a need for a security system that can receive numerous alerts associated with the security of a facility, evaluate the alerts to determine which alerts require attention, generate alarms and notifications, determine group of recipients who are authorized to deal with the alert, determine what message to send to the group of recipients, send the message by wireless radio signal, and record acknowledgments from the recipients. Such a security system should also be able to perform self-tests to determine if critical parts of the system are operational and, if not, summon maintenance personnel for correction.

SUMMARY OF THE INVENTION

In one aspect of the present invention, a method for notifying a recipient of an alarm condition detected by a security system is provided, where the method comprises the steps of generating a synthesized voice message to notify the recipient of the detected alarm condition; programmatically selecting a communications channel upon which to send the synthesized voice message; and transmitting the synthesized voice message to the recipient on the selected communications channel. The step of generating the synthesized voice message may further comprise the steps of selecting a textual notification message in response to the detected alarm condition and converting the textual notification message into a synthesized voice message. Also, the step of programmatically selecting the communications channel may further comprise the steps of selecting a communications channel identifier in response to the detected alarm condition, sending the communications channel identifier to a communications interface, and conditioning the communications interface in response to the communications channel identifier to both select a communications channel from a plurality of communications channels and to send the synthesized voice message on the selected communications channel. Finally, the step of transmitting the synthesized voice message may further comprise the steps of sending the synthesized voice message to a communications interface configured to use the selected communications channel and waiting for the communications interface to transmit the synthesized voice message on the selected communications channel.

In another aspect of the method of present invention, the method may further include the step of associating, with each alarm condition detectable by the security system, a group of recipients, a notification message, and a communications channel identifier.

In another aspect of the method of the present invention, the step of converting the textual notification message into a synthesized voice message may further be broken down into the act of processing the textual notification message through voice synthesis software and sending the processed textual notification message from the voice synthesis software to a sound card to provide a synthesized voice message. In particular, the sound card may a Soundblaster sound card.

In still another aspect of the present invention, the method may optionally include the step of receiving an acknowledgement from the recipient receiving the synthesized voice message on the selected communications channel. The acknowledgement may be in the form of a value encoded through a standard DTMF (Dual Tone Multiple Frequency) signal, a standard protocol well known in the art; but it may also be in the form of a voice response, where the voice response may be interpreted using standard voice recognition software well known in the art.

In still another aspect of the present invention, a security system is provided, where the security system has a plurality of sensors installed within a facility, each sensor configured to detect a condition and generate an alert in response. The security system facilitates the transmission by wireless means of a notification to a recipient having a handheld radio. The security system may comprise a central computer hosting a database, the central computer asynchronously receiving the alert and querying the database to provide a communications channel indicator associated with the alert and a textual message associated with the alert, the central computer having a means to convert the textual message into a synthesized voice message; one or more radio transmitters, each radio transmitter capable of selectively transmitting on a plurality of communications channels, each communications channel assigned to only one radio transmitter; one or more handheld radios, each handheld radio assigned to and carried by a recipient, each handheld radio configured to receive on a first communications channel and to transmit on a second communications channel, wherein the second and the first communications channels are different communications channels; a single radio receiver receiving transmissions on the second communications channel, wherein the second communications channel is common to all handheld radios; and a communications interface. The communications interface may have means for selecting a communications channel in response to receiving the communications channel indicator sent by the central computer, for configuring the radio transmitter associated with the selected communications channel to transmit on the selected communications channel, for transmitting on the selected communications channel the synthesized voice message received from the central computer, and for detecting an acknowledgement received on the radio receiver and sending the acknowledgement to the central computer.

In still another aspect of the present invention, the acknowledgement may be an acknowledgement code comprising a sequence of DTMF tones generated by a keypad on a handheld radio held by a recipient, the communications interface having a means of converting the DTMF tones into ASCII codes and sending the ASCII codes to the central computer.

In still another aspect of the present invention, the acknowledgement may be an audible voice signal provided by the recipient having the handheld radio, the audible voice signal being sent on a communications channel associated with the radio receiver, the communications interface having a means of sending the audible voice signal received on the radio receiver to the central computer. The audible voice signal may be decoded in the central computer using standard voice recognition software that may be well known in the art.

These and other features, aspects and advantages of the present invention will become better understood with reference to the following drawings, description, and claims. The present invention will now be described with reference to the following drawings, in which identical reference numbers denote the same element throughout.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention provides techniques for notifying security personnel of alert conditions by wireless communications means and then receiving an acknowledgment by the security person. The wireless communications means may be wireless telephony, radio, or any other communications system that does not require physical communications lines. A pager might also be used, but the recipient may acknowledge by other means than through the pager. The invention may also provide an apparatus and method for receiving the acknowledgment of the security person, receiving and responding to digital codes sent by the security person, and ensuring the operational readiness of critical components of the security system implementing these techniques.

Figure 1:
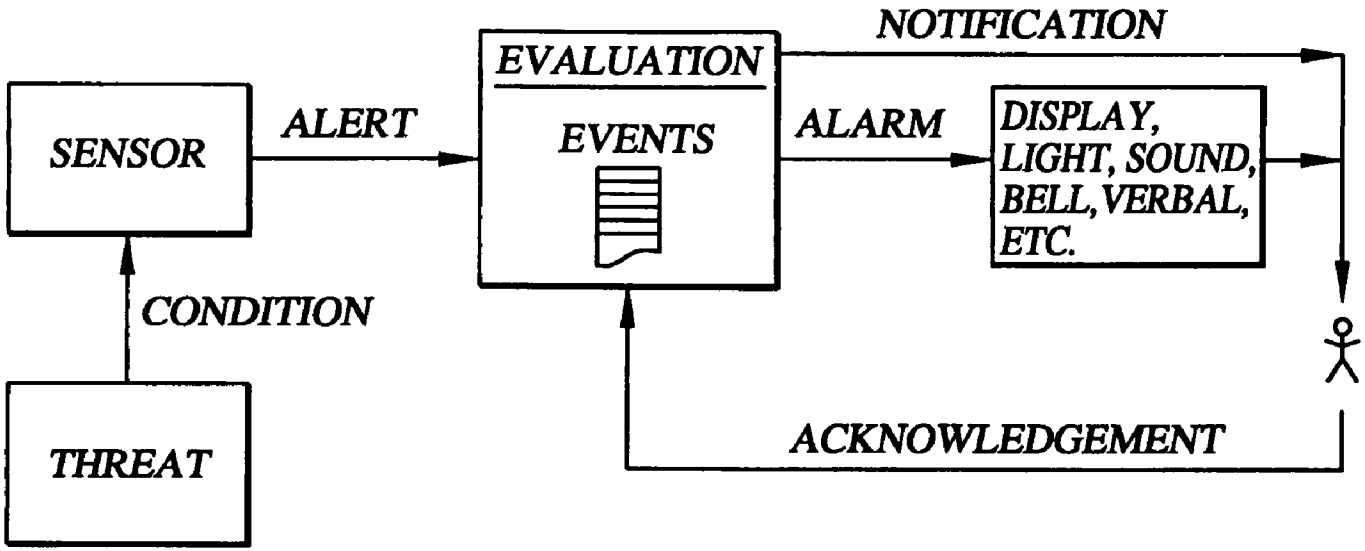
FIG. 1 is a logic diagram depicting the flow of actions involved in security systems embodying the present invention.
Figure 2:
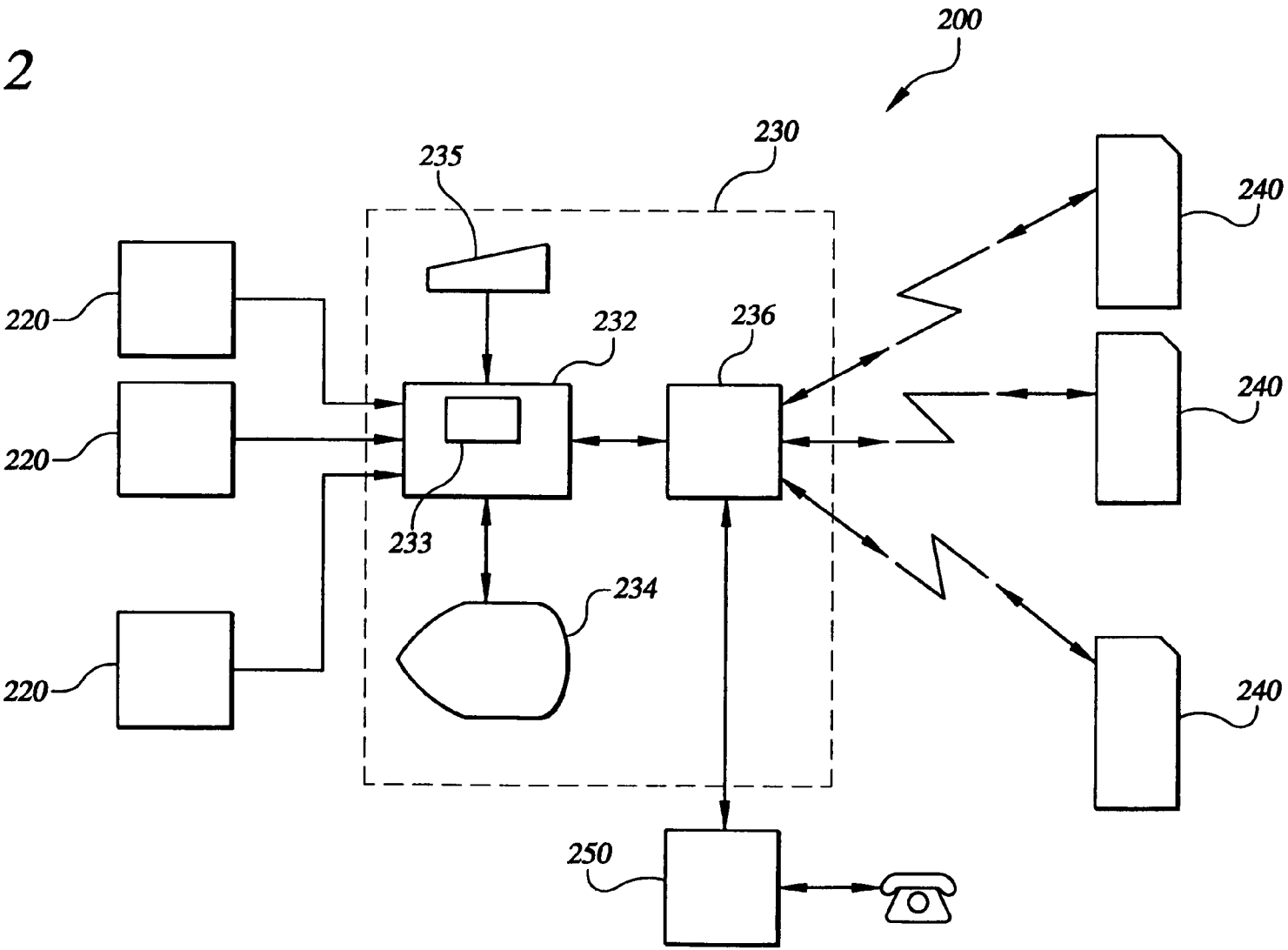
FIG. 2 is a functional block diagram of a security system embodying the present invention.

With reference to the diagram given in FIG. 2, a security system 200 is presented which embodies the present invention. Security system 200 consists of a central facility 230 which receives alarm conditions and sends alerts to personnel who are authorized to receive the alerts and who respond to the alerts. The central facility 230 typically comprises a computing means 232, a display device 234, a manual input device 235, and a communications interface means 236. The computing means 232 may be a small to medium sized personal computer sized to respond to and control one or more sensors 220 interfaced with the central facility 230. Such a small to medium sized personal computer, by way of example, may be typically based upon microprocessors such as those manufactured by the Intel corporation having the trademark "Pentium" or similar devices by other manufacturers, the microprocessor having a clock speed of from 500 MHz to 1 Ghz or more. The display device 234 presents a status of the sensors 220 to operators who can continuously monitor the status of the security system 200. The display device 234 may consist of display devices known to the art, such as cathode ray tubes, plasma panels, light indicators, and the like. Manual input device 235 is used by the operator to input data parameters into the computing means 232 and control the disposition of alarm conditions. Manual device 235 may consist of manual input devices known to the art, such as keyboards, trackballs, mouse devices, buttons, dials, and the like. The communications interface means 236 serves to interface the central computing means 232 to one or more receiving devices 240. It receives data and control signals from the computing means 232, relays the information contained in the data by wireless means to one or more receiving devices 240, and receives and decodes the response from the receiving device 240.

Sensors 220 are typically off-the-shelf devices used to detect a given condition and respond by generating a signal, or alarm, that is sent to the central facility 230. Sensors 220 are interfaced to the central facility 230 by methods typically employed by persons skilled in the art. Examples of such interfaces are Category 5 wiring, infrared signaling, ethernet, twisted pair wiring, and fiber optic wiring, by way of example and not limitation. When employed in a security system 200 such as the system provided by the present invention, they detect such conditions as open containers, door status (i.e. open or closed), high/low temperature, high/low voltage, smoke detectors, and motion in a given area. The sensors 220 may also be provided with audible alarms and visual indicators (such as rotating beacons) to additionally warn personnel in the vicinity of the alarm of the alarm condition. The sensors 220 may additionally be configured to respond to a signal from the security facility 230 and react according to a prearranged protocol. Such responses may be, for example, the silencing of an audible alarm, turning off a rotating beacon, disabling the sensor, or enabling the sensor.

Receiving devices 240 allow individual persons to receive audible voice messages originating from computing means 232 and transmitted by the communications interface means 236. Receiving devices 240 also may have a keypad allowing the user of the receiving device 240 to input digital messages by entering a code on the keypad or to enter telephone numbers for remote dialing. In an embodiment of the invention, receiving devices 240 may be handheld radio sets, such as, by way of example, a Motorola Model SP50 portable radio unit, which both transmit and receive signals (Motorola is a registered trademark of Motorola, Inc., Schaumburg, Ill.). In this particular example, a half-duplex transmission mode may be used where the receiving device 240 either receives a signal or transmits a signal, but not both activities simultaneously.

Figure 3:
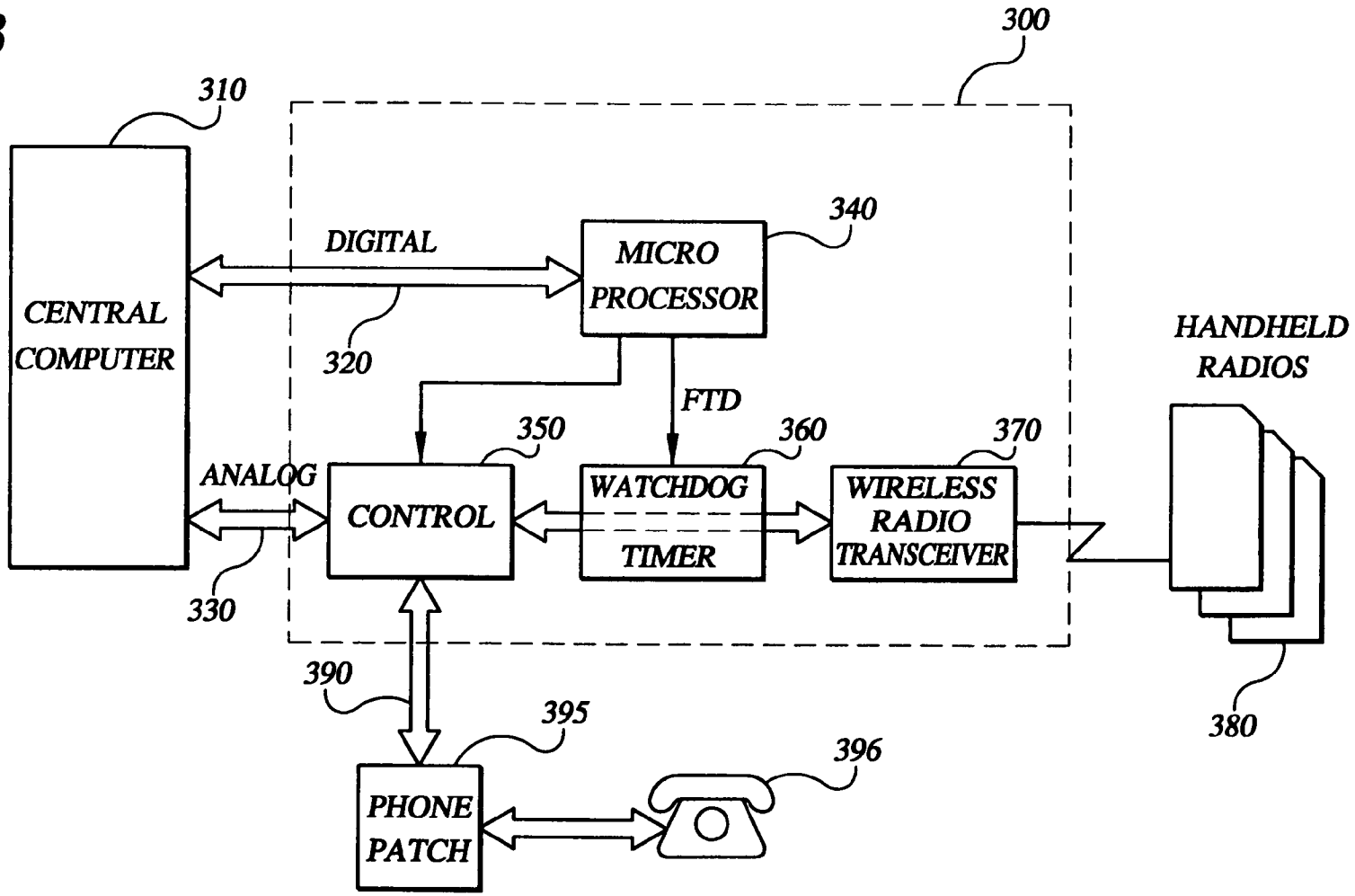
FIG. 3 is a functional block diagram of a wireless communications interface apparatus that interfaces a computing means to a wireless transmission means, according to preferred embodiments of the present invention.

FIG. 3 presents a functional block diagram of an embodiment 300 of the communications interface means 236 according to the invention. Embodiment 300 of the communications interface may provide a means for central computer 310 to communicate with handheld radios 380. It may exchange digital signals 320 with and receive analog signals 330 from a central computer 310. The digital signals 320 from central computer 310 may provide information and commands to a microprocessor 340 for conditioning various control circuits 350 within the interface that are involved with handling analog signals 330. Embodiment 300 of the communications interface also may route analog signals 330 between the central computer 310, handheld radios 380, and a phone patch 390. The actions involved with routing the analog signals 330, to be described in more detail presently, may be such actions as the selecting a wireless radio transceiver 370 for transmitting the an audio signal 330, receiving acknowledgments from the handheld radios 380, and connecting a wireless radio transceiver 370 to a phone patch 390 so that the handheld radio user may talk over the standard telephone lines. In addition, a watchdog timer 360 may be, provided to monitor the operational status of the communications interface and generate a pre-scripted audio signal to all transceivers 370 whenever the communications interface becomes non-operational.

The system comprising the central computer 310 and the communications interface 300 may be designed to operate in at least two modes. A Computer Voice Mode may be provided to transmit a synthesized voice audio signal to a selected radio channel. A Phone Patch Mode also be provided to allow an individual having a handheld radio to manually select the mode using codes entered on the keypad of the handheld radio and to communicate in a half-duplex transmission with another individual on a telephone by means of a phone patch in the communications interface 300.

According to the Computer Voice Mode, the present embodiment may include a set of communications channels in which a single channel is assigned to receive all transmissions from the handheld radios and the remaining channels are assigned to transmit to the handheld radios. Each handheld radio may be configured to receive audio notifications on the single channel and to transmit on one of the remaining channels. Persons designated to receive audible notification messages of an alarm event may be provided with a handheld radio of a type exemplified by the Motorola Model SP50 Handheld Portable Radio; other similar handheld radios could be used without departing from the scope of the invention. The central computer facility may be provided with transceivers of a type exemplified by the Motorola M1225 Mobile Radio, although other similar transceivers could be used without departing from the scope of the invention. One or more such transceivers may be functionally designated as transmitters, or transmit radios, and a single transceiver may be functionally designated as a receiver, or receive radio. Each of the transceivers may operate in half-duplex mode, with the receive radio being assigned to the single channel to receive all transmissions from the handheld radios and the transmit radios assigned to several channels selected from the remaining channels for transmitting to the handheld radios. In the present embodiment, each Motorola Model M1225 transceiver designated as a transmit radio may be assigned three frequencies, or channels (although the Motorola Model M1225 may permit up to four such channels) for transmitting to the handheld radios, and these assigned frequencies may, be different for each radio. Furthermore, the selected frequencies may overlap between transmit radios, that is, several transmit radios may assigned to the same frequency but each radio might also have a frequency not assigned to the other transmit radio.

Although in this embodiment a single frequency is assigned to function as a single channel, other methods of transmission may be used without departing from the scope of the invention. For example, the frequency may be divided into numerous channels using the industry standard known as Continuous Tone Coded Sub-Audible Squelch, or CTCSS, in which channels on the same frequency are differentiated by using different sub-audible tones that are recognized by the radios. Some manufacturers use a subset of CTCSS, such as the PL (Private Line) tone as implemented by Motorola. Another industry standard known as CTCSS/DCS may also be used, where a message transmission is preceded by a short 9-bit tone burst that identifies the channel, which continues until the carrier, is no longer present. Some manufacturers use a variant of CTCSS/DCS, such as the DPL (Digital Private Line) tone as implemented by Motorola. Any of these methods of identifying channels may be used without departing from the scope of the invention.

In this embodiment, all handheld radios may be configured to transmit on the same single frequency, and to receive on a selected frequency. The receive radio located at the central computer facility may be configured to receive on the same single frequency, so that all transmissions from any handheld radio may be received by the receive radio. The transceivers located at the central computer facility and designated as transmit radios may be configured to transmit on the various predetermined frequencies that various handheld radios are configured to receive, where the particular transmit radio and the particular channel assigned to that transmit radio may be selectable under programmatic control. The transmit radios may be configured to monitor the same frequencies upon which they transmit for traffic and to hold off transmission until the selected frequency is clear. This monitoring function may be provided by the transmit radio in the form of a Transmit Carrier-On-Relay (TxCOR) signal; when the frequency is clear, the transmit radio may de-assert, or remove, its TxCOR signal.

A protocol may be provided for sending a synthesized voice signal to a particular handheld radio or group of handheld radios that have been assigned the same radio channel. One or more transmit radios may be configured within the facility for sending voice messages to groups of recipients according to a pre-defined grouping plan. This grouping plan may establish one or more groups of recipients, each group being defined by an association with one or more alarm conditions. For example, certain guard personnel may be assigned to a particular building in a complex of several buildings; all the alarm conditions originating from that particular building would be assigned to the group of recipients responsible for the alarm conditions being generated within that building, such as for example, the guard personnel on duty, the supervisors, and the director of the building. These interested recipients would be provided with a handheld radio configured to receive messages sent on a pre-defined radio channel. Only those voice messages sent on the pre-defined radio channel assigned to the group would be received by the interested recipients. The identification of this pre-defined radio channel may be associated with the group within a database residing at the central computer facility. Additionally, a synthesized voice message may also be associated with an alarm condition within the central computer facility. Thus, the associations comprising the alarm-condition-to-voice message, alarm-condition-to-group, recipient-to-group, and radio-channel-to-group would be established beforehand within the database for access as needed, according to the prevailing situation.

When an alert condition is received by the central computer, it may be evaluated to determine what type of event it is and what types of actions are to be taken. If there is a requirement associated with the event for an audible or voice notification to be transmitted, then the central computer may retrieve all data associated with the event. In particular, the retrieved information may comprise the list of groups, the textual notification message associated with the group, and the radio channel associated with the group.

Figure 4:
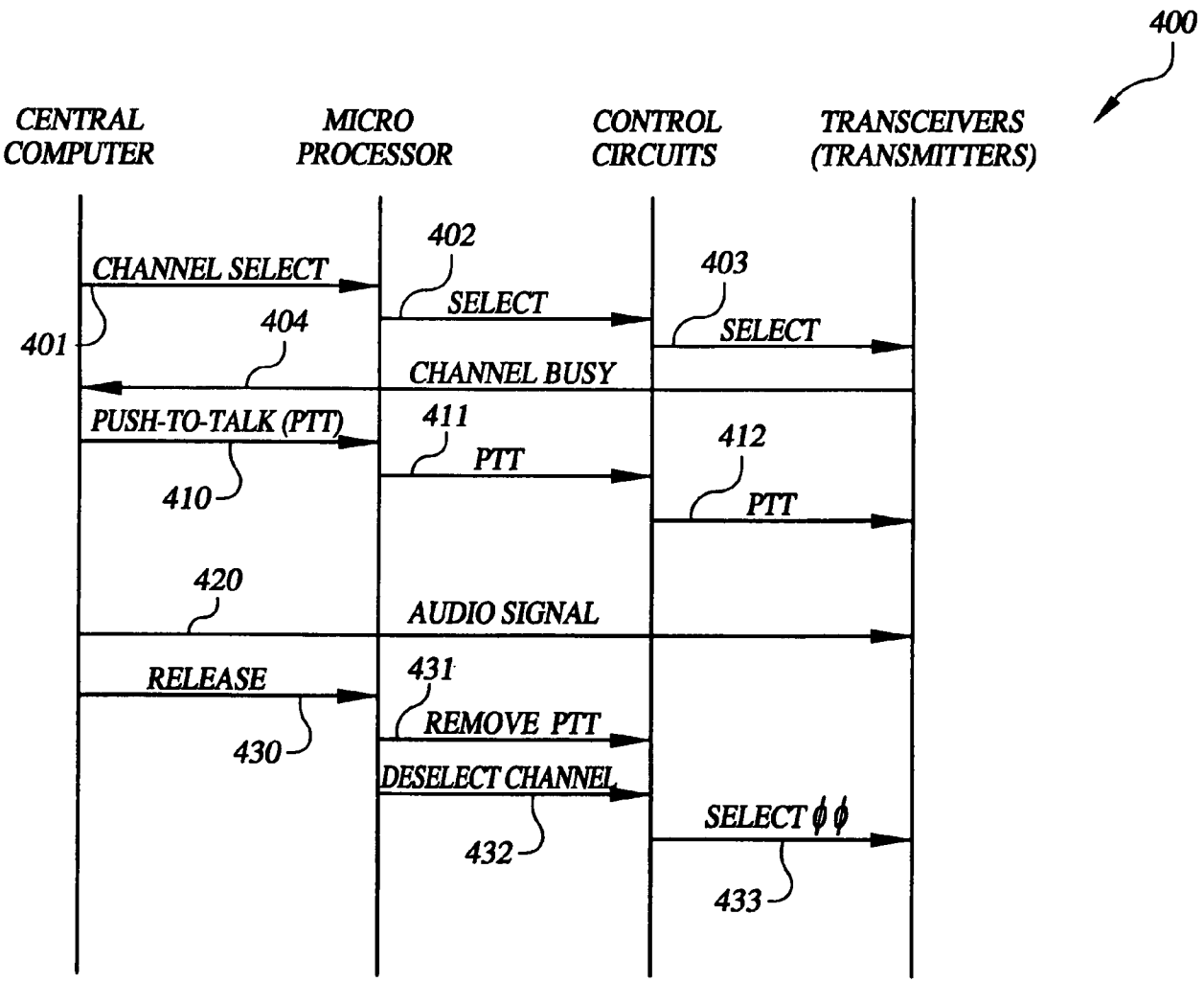
FIG. 4 is a flow diagram depicting the sequence of events involved in a transmission event for an alert, according to preferred embodiments of the present invention.

The timing diagram 400 shown in FIG. 4 depicts the communications protocol that occurs between the central computer, the interface computer, and the handheld radios, in terms of signals for sending a audible or voice notification message to a particular radio channel. The handshake protocol may be initiated when the central computer receives a signal from a sensor and determines to whom a voice message is to be sent. It may access the database to determine that a certain voice message needs to be sent to a certain group on a certain radio channel on a certain transmit radio. For each group of recipients, the central computer software program may access the radio channel associated with the group and, according to the signal designated as 401, send a channel selection signal to the microprocessor within the communications interface that commands the microprocessor to select and condition the selected transmit channel for transmission of a voice message, according to the signal designated as 402. The channel selection signal may be implemented in any number of methods and still remain within the scope of the invention, such as, by way of example, sending an ASCII message across an RS-232 interface where the message contains an identification of the requested channel or by conditioning a selected line where one line is provided for each channel.

Upon receipt of the channel selection signal 401, the microprocessor within the communications interface may decode the channel identification information from the signal 401 and condition the circuitry within the communications interface to select the indicated channel for transmission, according to the signal designated as 402. The control circuitry may accordingly send to the transceiver a digital code that selects the channel, according to the signal designated as 403. The microprocessor may then monitor the busy signal (TxCOR) received from the selected transmit radio, according to the signal designated as 404, until the channel is clear. In the embodiment shown, the busy signal 404 may be routed directly to the central computer without intervention by the microprocessor, the path having been previously conditioned as part of the selection process; however, the microprocessor could alternately receive the busy signal 404 and relay it to the central computer in some other form without departing from the scope of the invention.

When the channel is clear, a push-to-talk (PTT) signal may be sent to the selected radio transceiver to acquire the radio channel for use until the PTT signal is removed. In the embodiment shown, the central computer may respond to the channel busy signal 404 and send a PTT signal 410 to the microprocessor. The microprocessor may subsequently acquire the radio channel for use by sending a PTT signal 411 to the control circuits to condition relays within the interface to route a PTT signal to the selected transmit radio, according to the signal designated as 412, thus acquiring the channel and render the channel busy. In the embodiment that will be shown as an example, central computer may wait approximately 0.5 seconds after asserting the PTT signal 411 to allow the circuits to settle before sending a synthesized voice message; in other embodiments, the transmit radio may provide a ready signal to the central computer to notify the central computer that it is ready to receive messages. In still other embodiments, the microprocessor could alternately receive such a ready signal and relay it to the central computer either directly or as an ASCII message without departing from the scope of the invention.

When the central computer has waited a empirical duration of time, preferably 0.5 seconds in the embodiment to be described, it may then initiate the transmission of a synthesized voice message to the microprocessor by way of an audio interface, or sound card, according to the signal designated as 420. The text representing the audio message to be transmitted may be read from the database and directed to voice synthesis software within the central computer, which converts the text into a data stream that is in turn directed to the sound card for conversion into synthesized speech. A typical sound card may be of a type exemplified by the Soundblaster, manufactured by Creative Labs, Stillwater, Okla. (Soundblaster is a trademark of Creative Labs.) The audio signal 420 representing synthesized speech may then be directed from the sound card to the audio interface port of the central computer that is connected to a corresponding audio port on the communications interface. The communications interface hardware may receive the audio signal 420 from the port and direct it to the selected transmit radio, which may then transmit the audio signal on the selected channel; intervention by the microprocessor may not be required after the interface hardware has been so conditioned. This process may continue until the voice message is complete.

When the central computer has completed transmission of the voice message, it may then send a release signal to the microprocessor, according to the signal designated as 430. The microprocessor may decode the release signal 430 and remove the PTT signal from the selected radio transmitter according to the line designated as 431 to free up the channel. It may also deselect the channel according to the line designated as 432 by conditioning the control circuits to remove all electrical signals and levels from the channel identification circuits so that they select channel 00 by default, according to the line designated as 433.

It should be noted that the selection signal, busy signal, PTT signal, and the release signal may be implemented as a hardware interface consisting of conditioned lines or wires, or they may be implemented as a command interface in which a command is encoded by a sender and decoded by the receiver, or some combination of the two. Either method or equivalent methods may be used for individual signals and any combination of methods may be used for different signals, or multiple methods for the same signal, without departing from the scope of the invention. In the embodiment that follows, the signals have been implemented as explicit single commands issued by the central computer to set each individual relay as needed.

According to the Phone Patch mode, the user of the handheld radio may command the communications interface, by codes entered on the keypad of the handheld radio, to direct subsequent voice transmissions to and receive audio voice transmissions from a phone patch interface contained in the communications interface hardware. Although the embodiment of a hardware implementation of the Phone Patch Mode will be subsequently described, it should be understood by those skilled in the art that the same functionality may be implemented by software interaction or a combination of hardware and software components without departing from the scope of the invention.

When the user of a handheld radio according to the invention desires to respond in some way to the synthesized voice message, the user may enter a special code on the keypad of the handheld radio that identify the user and provide an acknowledgement. The special code may be stored in the database residing in the central computer for access later. The handheld radio generates a series of discrete tones according to DTMF standards that may be transmitted to the receive radio at the central computer facility and thereupon directed to the microprocessor containing a tone decoder module in the interface hardware, such as exemplified by an MT8870 DTMF decoder. The decoder module may decode the tones to provide a series of ASCII characters representing the acknowledgment code. This code may be sent by the microprocessor to the central computer for identification of the recipient. In the central computer, the acknowledgement code may be compared against a list of sent alerts to determine whether or not the alert is being handled; if not, the central computer may take further corrective action to ensure that some individual accepts responsibility for handling the alert.

Figure 5A:
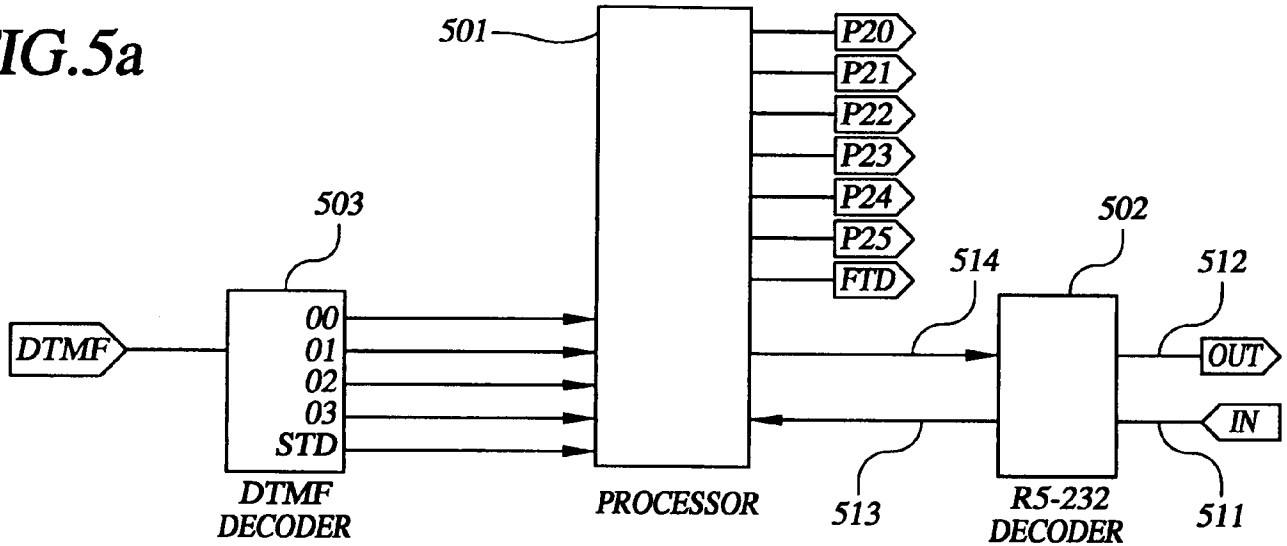
FIG. 5*a* is a simplified circuit schematic showing the primary processing elements of the wireless communications interface apparatus, according to preferred embodiments of the present invention.
Figure 5B:
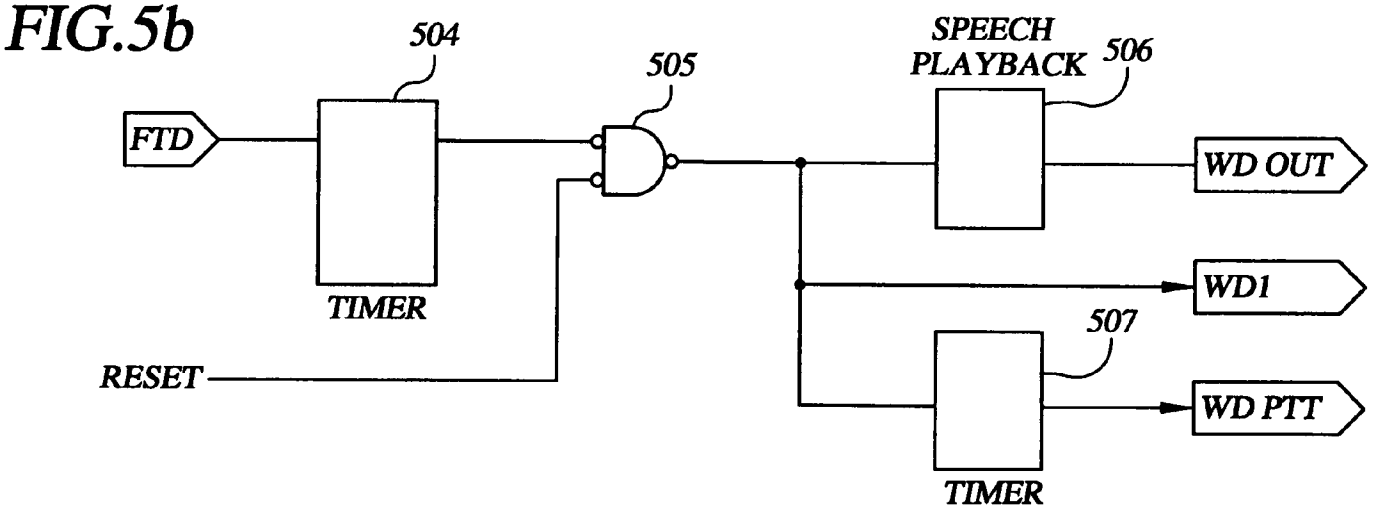
FIG. 5*b* is a simplified circuit schematic diagram showing the watchdog timer circuit for the wireless communications interface apparatus, according to preferred embodiments of the present invention.
Figure 5C:
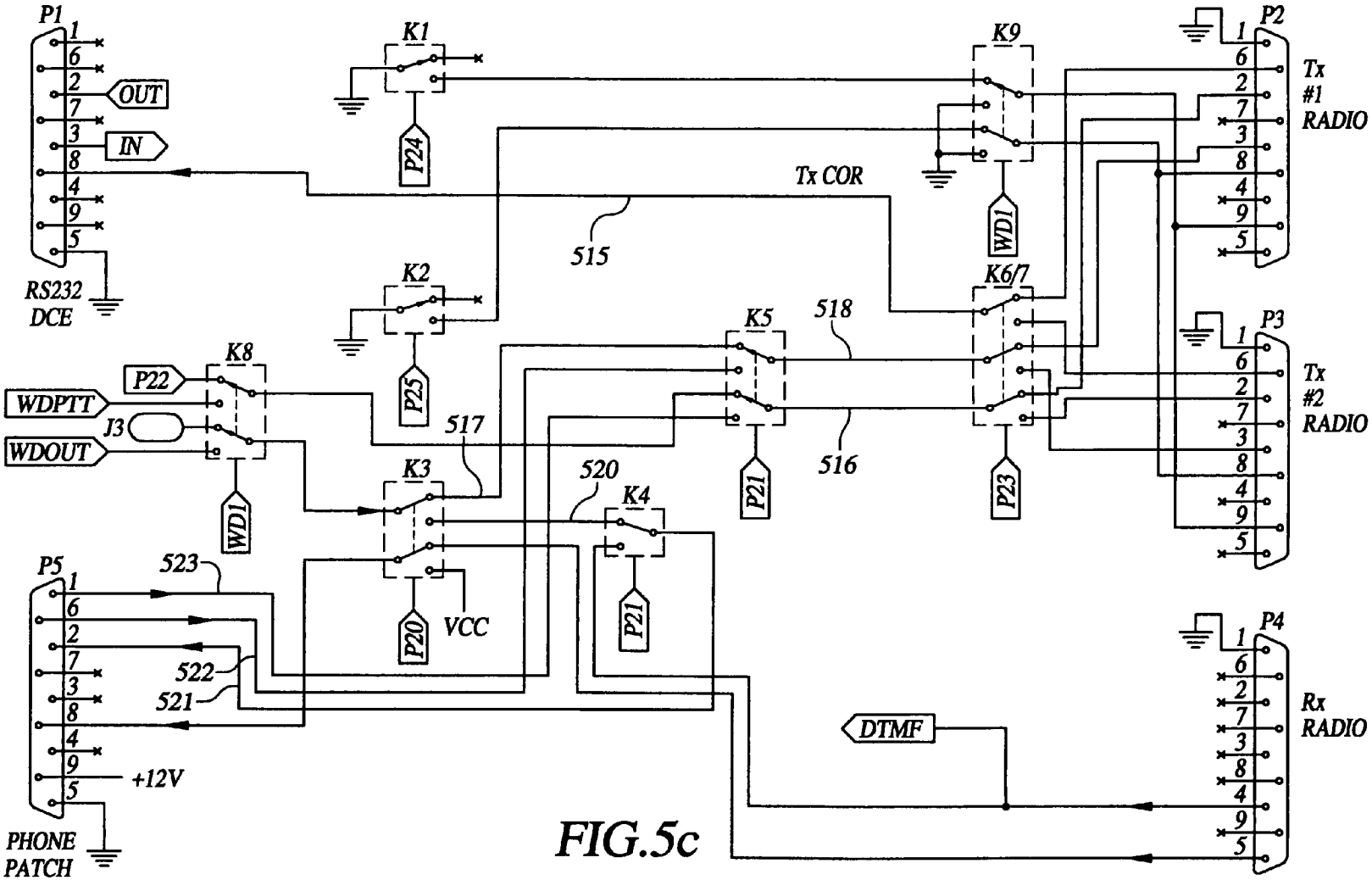
FIG. 5*c* is a simplified circuit schematic diagram illustrating the preferred logic circuit of the wireless communications interface apparatus, according to preferred embodiments of the present invention.

Referring now to FIGS. 5*a*, 5*b*, and 5*c*, a simplified schematic diagram of an embodiment of the electronic components of the wireless communications interface is shown. It should be noted that standard electrical components well known in the art for conditioning, timing, and shaping the electrical signals between the components described therein have been omitted for brevity and to promote understandability of the logic and data flow of the interface. Such omitted components might be resistors, capacitors, chokes, coils, linear amplifiers, and other such components. The intent is to provide a simplified diagram that focuses on the logic implemented by the electrical signals and messages while at the same time describing one particular embodiment for practicing the invention. Those skilled in the art of electrical engineering may provide additional components for conditioning, timing, and shaping electrical signals, as well as substitute components, according to the particular functions indicated therein without departing from the scope of the invention. For example, physical relays are shown in the figures, but other logic devices, such as flip-flops, gates, or even specially programmed logic arrays, may be used to provide the same selection function.

All jacks and plugs through which the wireless communications interface exchanges data, signals, and messages with external devices may be shown in FIG. 5*c*. Communication with the central computer may be accomplished by means of signals transmitted through plug P1 and jack J3.

Plug P1 may be a standard 9-pin DB9 connector for a standard RS-232 interface. Messages comprising standard serial ASCII characters may be exchanged between the central computer and microcomputer 501 by the interface shown as plug P1. In this way, the microcomputer 501 may receive variable data, such as a channel identification code or specific commands, decode the data/commands, and perform functions accordingly. Such functions may be implemented by asserting signals to set relays or switches, as may be seen in subsequent description. Providing a microcomputer 501 as part of the communications interface hardware allows flexibility for future enhancements and modifications to the communications interface. Microcomputer 501 may preferably be a standard microcomputer such as an Intel 8051 microprocessor, although any similar microprocessor may be used without departing from the scope of the invention. ("Intel" is a trademark of the Intel Corporation, Santa Clara, Calif.) Additionally, a programmed logic array (PLA) or similar electrical component could also be used in place of microcomputer 501 without departing from the scope of the invention.

Jack J3 may be used to receive an analog audio signal from the central computer, where the audio signal may comprise synthesized voice messages provided by the central computer through its sound card or actual speech from recordings, or any combination of the two. In this embodiment, it is assumed for purposes of illustration that the analog audio signal represents speech that is synthesized and controlled by the central computer.

The communications interface in the present embodiment may be connected to the transceivers by means of plugs P2, P3, and P4. Communication with the transmit radios associated with the communications interface may be accomplished through plugs P2 and P3. Communication with the receive radio associated with the communications interface may be accomplished through plug P4. The designation of a transceiver as either transmitter or receiver is only made for because of the manner in which the transceiver functions within the communications interface; the transceivers, for practical purposes, may be the same make and model and thus interchangeable. Plugs P2, P3, and P4 may be standard DB9 serial interface plugs that are well known to the art. The transceiver connected with plug P2 may be designated as Tx #1 Radio, the transceiver connected with plug P3 may be designated as Tx #2 Radio, and the transceiver connected with plug P4 may be designated as Rx Radio. The radios preferably may be Motorola M1225 Mobile Radios. The M1225 mobile radio is programmable and has a special Molex plug with its own pin assignments. A special DB9 connector may be fabricated for the Tx #1 Radio and Tx #2 Radio, where the connector pins have the following functionality:

Pin 1—Ground
Pin 2—Push-to-Talk (PTT)
Pin 3—Audio out
Pin 4—(not used)
Pin 5—(not used)
Pin 6—Tx Carrier-On-Relay
Pin 7—(not used)
Pin 8—channel (MSB)
Pin 9—channel (LSB)

Similarly, a special DB9 connector may be fabricated for the Rx Radio, where the connector pins have the following pin functionality:

Pin 1—Ground
Pin 2—(not used)
Pin 3—(not used)
Pin 4—Audio In
Pin 5—Rx Carrier-On-Relay
Pin 6—(not used)
Pin 7—(not used)
Pin 8—(not used)
Pin 9—(not used)

Note that the pins used by the Tx #1 Radio and Tx #2 Radio and the pins used by the Rx Radio are compatible, so that a plug fabricated for the Tx Radios may be used with a Rx Radio without encountering difficulty.

Channel selection may be performed for the Tx #1 Radio and Tx #2 Radio by grounding bits 8 or 9, or both. This particular radio recognizes a ground as a logical "True". Allowing one or both of these pins to float results in an internal "False" indication. Since there are two bits assigned to the channel identification, then there are four possible channel designations available for each radio. Channel 4 (00) may be programmed to default to manual setting on the front panel of the radio. Channel designation for the Rx Radio is irrelevant since this radio may receive on the common channel used by all handheld radios for talking. While only two transmit radios are shown for illustrative purposes, additional transmit radios may be configured With suitable modifications to the circuitry and logic as shown, without departing from the scope of the invention.

Relays K1 through K7 may allow the microprocessor 501 to directly control signals and data between the various components of the communications interface according to the function desired. Microprocessor 501 may provide internal signals P20 through P25 to condition the relays K1 through K7 and to assert signals peculiar to the radios, depending upon the commands received from the central processor. Internal signals P20 through P25 may function as follows:

P20—State change for relay K3
P21—State change for relay K4
P22—Push-to-Talk Signal
P23—State change for relays K6 and K7
P24—State change for relay K1
P25—State change for relay K2

Note that although relays K1 through K7 are shown in their default, or power up state, and as physical switches, they may also be implemented by standard switching devices known to the art, such as transistors, flip-flops, gates, and the like, without departing from the scope of the invention. In this embodiment, the central computer may command the microprocessor 501 to set/reset each individual relay by means of a separate command. Other embodiments may also be used in which multiple relays may be simultaneously set/reset by the same command. Still other embodiments may be used in which the central computer sends a functional command that is interpreted by the microprocessor to selectively set/reset relays. All such embodiments may be considered to be within the scope of the invention.

Microprocessor 501 may also provide another internal signal designated as FTD, or Feed-the-Dog, to an internal watchdog timer (FIG. 5*b*). In the embodiment shown, the central computer periodically sends a signal to the microprocessor 501 to indicate that it is still operating. The FTD signal may be periodically provided by microprocessor 501 to indicate both that the microprocessor 501 is still processing normally and that the central computer is processing normally. If the microprocessor 501 detects an anomalous condition or if it ceases to function, then FTD may not be provided and the watchdog timer, detecting the absence of FTD, may then function, as described presently. The watchdog timer may control relays K8 and K9 and provide internal signal WD1, all of which allow it to internally take over the transmit function of the communications interface.

When the communications interface is operating in Computer Voice Mode where central computer typically sends a notification comprising a synthesized voice message to interested personnel, the central computer may sequentially perform the actions of selecting a transmission channel, waiting for the channel to become free, sending the synthesized voice message to the selected channel, and finally releasing the selected channel. All actions performed by the communications interface may typically be directed by the central computer. Each of these actions will now be described in terms of the communications interface functionality.

To select a channel, the central computer may send a command message comprised of a series of ASCII characters to the communications interface via Plug P1 (FIG. 5*c*). The bits comprising input characters are received through pin 3 of Plug P1 and directed to a standard RS-232 Converter 502 (FIG. 5*a*) through RS-232 input line 511. The RS-232 Converter 502 may preferably comprise a standard integrated circuit for RS-232 conversion, such as an ICL232 or similar circuit, but any similar circuit (including discrete components) having similar function may be used within the scope of the invention. The input characters are, passed from the RS-232 Converter 502 through line 513 to the microprocessor 501 where they may be decoded as a command. The decoding of the channel select command by microprocessor 501 may then cause internal signals P24 and P25 to be conditioned to select channel 1 (01), 2 (10), or 3 (11) according to the contents of the channel select command. Internal signal P24 may condition relay K1 to send an internal channel select signal to pin 9 of Plugs P2 and P3, and internal signal P25 may condition relay K2 to send an internal channel select signal to pin 8 of Plugs P2 and P3, where jointly P24 and P25 reflect the binary number (01, 10, 11) of the selected channel and where P24 is the least significant bit. Microprocessor 501 may additionally select the radio to be used for transmission, i.e. Tx Radio #1 or Tx Radio #2, according to the state of internal signal P23 which may be routed to Relays K6 and K7 for selection of the desired radio. Note that the channel number may be routed to both radios, but only one radio is selected for use.

The central computer may then wait for the channel to become free. Bit 6 of Plugs P2 or P3 may carry the TxCOR (Transmit Carrier-On-Relay) signal for each radio, which functions as a "busy" signal. This signal may be routed through line 515 to bit 8 of Plug P1, where it may be monitored by the central computer. The TxCOR signal may be high when the channel is in use and low when the channel is available for use.

When the TxCOR signal becomes low, indicating that the selected radio channel is available for use, the central computer may initiate the transmission of the audible notification message. It may send a PTT command message to the microprocessor 501, which may decode the command and asserts internal signal P22. Internal signal P22 may be sent as an input to relay K5 which may route internal signal P22 through PTT line 516 to pin 2 of either Plug P2 or P3, depending upon the state of relays K6 and K7. Since pin 2 of Plug P2 or P3 may be the PTT input to the respective radio, this action effectively seizes the transmission channel for use. The central computer may then wait at least 500 ms to allow the radio to settle and stabilize, and then may initiate transmission of its audio signal through Jack J3. The audio signal may be routed from Jack J3 through relay K3, audio in line 517, Relay K5, and audio transmit line 518 to pin 3 of either Plug P2 or P3, depending upon the state of relays K6 and K7.

At the conclusion of the audio message, the central computer may then release the channel by sending a release command message to the microprocessor 501, which may decode the command and take actions to remove internal signal P22 and to deselect the selected channel. Removing the internal signal P22 may result in removing the PTT signal to the selected radio. The deselection of the selected channel may be accomplished by removing internal signals P24 and P25, resulting in a selection of default channel 0 (00).

At any time during the transmission to the handheld radio the user may enter a digital message on the keypad of the radio, which is transmitted as a series of DTMF tones back to the communications interface and received by the Rx Radio. For example, such a digital message may be entered by the handheld radio user in order to acknowledge the audible notification message that was received. The DTMF tones may be asynchronously sent to the communications interface through pin 4 of Plug P4. They may be intercepted as internal signal DTMF and sent to the DTMF decoder 503

(FIG. 5*b*). The DTMF decoder may typically sense the tone and generates a 4 bit parallel signal on lines D0, D1, D2, and D3, with an accompanying interrupt strobe STD. These five lines may be directly connected to the microprocessor 501, which may recognize the input via an interrupt generated by the presence of interrupt strobe STD. The four bits may comprise a code that may be formatted as a message and sent to the central computer for action. The message may be transmitted through line 514 to the RS-232 Converter 502 which in turn may perform the handshake protocol with the central computer and transmit the message through the output line 512. Optionally, the microprocessor 501 may be programmed to perform some action directly within the communications interface in response to the receipt of the DTMF code. Depending upon how the central computer is programmed to respond to such a DTMF tone entered by the handheld radio user, the computer may reset sensors, turn off alarms, display digital messages at the operator's console, etc.

When the communications interface is operating in Phone Patch Mode, where the handheld radio user may request the communications interface to open a path between the handheld radio and the phone patch, the central computer may not be involved to a great extent. The communications interface may sequentially perform the actions of setting up a path between the transmit radio (Tx #1 or Tx #2 Radios), the receive radio (Rx Radio), and the phone patch and of waiting for a terminate code from the handheld radio or a timeout, whichever event occurs first. The handheld radio user may be allowed to control the interaction with the phone patch by means of the transmit button on the handheld radio. Each of these actions will now be described in terms of a representative embodiment of communications interface functionality.

In one representative embodiment illustrating the Phone Patch Mode, one unique channel, called the Phone Patch Channel, may be assigned the functionality of hosting all phone patch interactions by all handheld radio users in the system. Since this same channel would be designated as the phone patch channel for all transmit transceivers (Tx #1 Radio and Tx #2 Radio), then all transmit transceivers would be configured for the same frequency for the phone patch channel. The phone patch device, not shown, may be connected to the phone patch plug P5. It may typically be a half duplex device having separate transmit and receive modes controllable by a special tone, typically that represented by a "#" or "*" code on the keypad of the handheld radio. A special DB9 connector may be fabricated for the phone patch device, where the connector may have the following pin functionality:

Pin 1—Push to Talk (PTT)
Pin 2—Audio Out (from communications interface)
Pin 3—(not used)
Pin 4—(not used)
Pin 5—Ground
Pin 6—Audio In (to communications interface)
Pin 7—(not used)
Pin 8—External Carrier-On-Relay (COR)
Pin 9—+12 v.

For illustrative purposes for this description of the embodiment, the Phone Patch Channel may be designated as Channel 1. A phone patch request code, available for use by all handheld radio users, may be entered by a handheld radio user on the keypad of the handheld radio to command the communications interface to enter Phone Patch Mode. This phone patch request code may be transmitted on Channel 1 of that radio and received by the receive transceiver, Rx Radio. The code, represented by a DTMF tone, may be provided at pin 4 of plug P4 by the Rx Radio and routed to the DTMF Decoder 503 to decode the tones into a 4 bit code, which may subsequently be sent to the microprocessor 501 where it may be transformed into an ASCII code for transmission to the central computer. The central computer may interpret the code and, if the handheld radio user has permission to establish the phone patch, send an appropriate phone patch code back to microprocessor 501 to assert internal signals to establish the phone patch mode in the communications interface. A timer may be set up in the central computer so that a disconnect signal may be sent to microprocessor 501 if the phone patch conversation exceeds pre-established limits. Alternatively, the central computer may send a signal to the microprocessor 501 to initiate the phone patch, whereupon the microprocessor 501 may set a timer to limit the length of the subsequent phone conversation and then condition circuits to establish the phone patch. Either method or similar methods to control the length of the phone patch conversation may be used without departing from the scope of the invention.

In response to commands sent by the central computer, the microprocessor 501 may select the appropriate channel by asserting internal signals P24 and P25 with appropriate values to select Channel 1 of the transmit transceivers (Tx #1 Radio and Tx #2 Radio). Microprocessor 501 may then assert internal signal P21 to condition relays K4 and K5. The conditioning of relay K4 may cause subsequent audio signals arriving at the Rx Radio (pin 4, Plug P4) to be connected to the Audio Out line (pin 2, Plug 5) of the phone patch. The conditioning of relay K5 may cause subsequent audio signals arriving from the phone patch (pin 6, Plug P5) to be connected with the Audio Out line of Tx #1 Radio (pin 3, Plug P2); the audio signal may be routed from Plug P5 (pin 6), through phone in line 522, Relay K5, audio transmit line 518, Relay K6/K7 to pin 3, Plug P2. Finally, the conditioning of relay K5 may also cause the phone patch PTT (pin 1, Plug P5) to be connected to the Tx #1 Radio PTT (pin 2, Plug P2). The phone patch PTT signal (pin 1, Plug P5) may be routed through the phone PTT line 523, Relay K5, PTT line 516, Relay K6/K7, to pin 2, Plug P2. When the communications interface has been set up in the Phone Patch Mode in this manner, microprocessor 501 may wait until the timer in the central computer times out and the central computer sends commands to terminate the Phone Patch Mode by resetting the interface hardware. In this manner, the communications interface may not be monopolized by a telephone conversation and be made available for further alarm notification actions.

While in Phone Patch Mode, the handheld radio and the phone patch device jointly operate in a half-duplex configuration. When the handheld radio user talks, the transmit button on the handheld radio may be pressed, thus causing the RxCOR signal on pin 5, Plug P4, to be asserted. This signal may be received by the External COR input (pin 8, Plug P5) which may cause the phone patch to receive the audio signal from the Rx Radio. When the handheld radio user releases the transmit button, the RxCOR signal may be removed; this may be detected by the phone patch device, which may subsequently assert the PTT signal (pin 1, Plug P5) to allow the Tx #1 Radio to transmit the audio signal received from the phone patch (pin 6, Plug P5). The phone patch may remain in this configuration until the handheld radio user again presses the transmit button on the handheld radio.

There are many embodiments of the Phone Patch Mode that may be implemented according to the invention. One such embodiment that may be provided by the invention is to allow the handheld radio user to direct the central computer to automatically dial the telephone number associated with the last notification message transmitted through the communications interface, so that the handheld radio user can talk with an individual at the location where the associated alarm originated. This process may be termed LAAD, which stands for "Last Alarm Auto Dial", and may be designed by a special DTMF tone sequence entered by the handheld radio user (for purposes of this description, the sequence is arbitrary.) Each handheld radio user may be assigned a unique code for requesting LAAD capability. An alternative would be to assign each handheld radio user a unique acknowledgment code and to use a common code for requesting the LAAD capability; in this case, the central computer would have to save the last acknowledgement code that it received from the communications interface.

To initiate LAAD mode, the handheld radio user may enter the LAAD code on the keypad of the handheld radio and then change channels to Channel 1 (according to the previous discussion). The LAAD code may be transmitted by the handheld radio and received by the receive radio, Rx Radio. The code, represented by a DTMF tone, may be provided at pin 4 of plug P4 by the Rx Radio and routed to the DTMF Decoder 503 to decode the tones into a 4 bit code, which may subsequently be sent to the microprocessor 501 for transmission to the central computer. The central computer may decode the 4 bit code, determine that it is a LAAD code requested by a handheld radio user, and send an appropriate command back to microprocessor 501. Microprocessor 501 may then direct the communications interface to set up a path allowing the central computer to send a telephone number to the phone patch device connected to Plug P5. The microprocessor 501 may decode the message from the central computer and assert internal signal P20. Internal signal P20 may cause the subsequent audio signal arriving at Jack J3 and comprising the sequence of DTMF tones for the telephone number to be routed through relay K3 and dialing line 520 to send/receive relay K4. Microprocessor 501 may also assert internal signal P21 to condition relay K4 to allow the DTMF tones to be sent through the phone out line 521 to pin 2, Plug P5. After the DTMF tones are sent by the central computer, the central computer may then send a second message to microprocessor 501 to enter the Phone Patch Mode according to the sequence described previously for a manual request by a handheld radio user.

A Watchdog Timer may be included in the communications interface (FIG. 5*b*) for detecting when the central computer or the communications interface has ceased to function. When this occurs, the watchdog timer may send out a prescripted voice message to all recipients on a channel monitored by all handheld radios. During normal operation, the central computer at regular intervals may send a message comprising one or more ASCII characters to the microprocessor 501. The microprocessor 501 may decode the characters and generate a "Feed-the-Dog" (FTD) internal signal. The FTD internal signal may be sent to the Watchdog Timer to continuously reset a first timer chip 504, preferably an NE 555 monolithic timing circuit provided by semiconductor vendors such as Phillips Semiconductors. If both the central computer and the communications interface are in working order, the first timer chip 504 may be continuously reset (every 20 seconds during normal operation) so that it may be kept from timing out. If the FTD internal signal is not received by the first timer chip 504, either because the command triggering the FTD internal signal was not sent by the central computer or because of a malfunction in the microprocessor 501 of the communications interface that prevented the FTD internal signal from being received by the first timer chip 504, then first timer chip 504 may time out and generate an internal signal WD1 to a speech chip 506 containing a pre-scripted audio message; although any suitable speech chip may be used, an ISD1110 Speech Playback Chip is preferable. The ISD1110 is capable of holding record speech of up to 10 seconds in duration. The internal signal WD1 may also condition relay K8 (FIG. 5*c*), which may cause a switch from the computer audio source from jack J3 to the watchdog timer speech source given by signal WDOUT.

A second timer chip 507 may be provided to control the push-to-talk signal WDPTT that may be sent to the radios to enable the radio to send the pre-scripted audio message. Like the first timer chip 504, the second timer chip 507 may preferably be an NE 555 monolithic timing circuit provided by semiconductor vendors such as Phillips Semiconductors. The output signal of the second timer chip 507 may be controlled by two resistors (not shown) associated with its inputs. These resistors may be appropriately chosen to control the transmit on/transmit off times of the timer chip. The values of these resistors may be chosen so that the second timer chip 507 provides an output (transmit time on) for 20 seconds and no output (transmit time off) for about 1 minute, 15 seconds. This output may be coupled to the PTT signal provided to the radios. In general, a transceiver must be turned off for a period of time to prevent it from overheating from a continuous signal; therefore, the second timer chip 507 may be provided. Relay K8 may also be used to switch from the PTT signal P22 generated by the communications interface to the WDPTT signal generated by the watchdog timer.

It may be desirable to send the message contained on the speech playback chip 506 to all radios. Therefore, channel 4 (00) may be selected. This may be accomplished by sending the WD1 signal to relay K9 (FIG. 5*c*), where both pins 8 and 9 may be grounded for both radios, thus selecting channel 4.

As has been demonstrated, the present invention provides an advantageous system, apparatus, method, and computer program product that facilitate the wireless transmission of a notification of an alarm signal to a recipient having a hand held radio and receiving a response, or acknowledgement, from the recipient. The invention may selectively send notification messages based upon groups of interested individuals and retransmit the notification message to another individual or group of individuals if no individual in the first group responds with an acknowledgement within a given time period.

As will be appreciated by one of skill in the art, embodiments of the present invention may be provided as methods, systems, or computer program products. Accordingly, the present invention may take the form of an embodiment comprised only of hardware, an embodiment comprised only of software, or an embodiment combining software and hardware aspects. Furthermore, the present invention may take the form of a computer program product which is embodied on one or more computer-usable storage media (including, but not limited to, disk storage, CD-ROM, optical storage, and so forth) having computer-usable program code embodied therein.

The present invention has been described with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, embedded processor or other programmable data processing apparatus to produce a machine, such that the instructions, which execute via the processor of the computer or other programmable data processing apparatus, create means for implementing the functions specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions specified in the flowchart and/or block diagram block or blocks.

While the preferred embodiments of the present invention have been described, additional variations and modifications in those embodiments may occur to those skilled in the art once they learn of the basic inventive concepts. Therefore, it is intended that the appended claims shall be construed to include both the preferred embodiment and all such variations and modifications as fall within the spirit and scope of the invention. It should be understood, of course, that the foregoing relates to preferred embodiments of the invention and that modifications may be made without departing from the spirit and scope of the invention as set forth in the following claims.

I claim:

1. A security system for providing notification of alerts, the system having a plurality of sensors installed within a facility, each sensor configured to detect a condition and generate an alert thereupon, the system comprising:

a central computer hosting a database, the central computer asynchronously receiving the alert and querying the database to provide a communications channel indicator associated with the alert and a textual message associated with the alert, the central computer having a means to convert the textual message into a synthesized voice message;

one or more radio transmitters, each radio transmitter capable of selectively transmitting on a plurality of communications channels, each communications channel assigned to only one radio transmitter;

one or more handheld radios, each handheld radio assigned to and carried by a recipient, each handheld radio configured to receive on a first communications channel and to transmit on a second communications channel, wherein the second and the first communications channels are different communications channels;

a single radio receiver receiving transmissions on the second communications channel, wherein the second communications channel is common to all handheld radios; and a communications interface having a means to select a communications channel in response to receiving the communications channel indicator sent by the central computer, the communications interface having a means to configure the radio transmitter associated with the selected communications channel to transmit on the selected communications channel, the communications interface having a means to transmit on the selected communications channel the synthesized voice message received from the central computer, the communications interface having a means to detect an acknowledgement received on the radio receiver and sending the acknowledgement to the central computer.

2. The security system described in claim 1, the communications interface additionally having a means to detect malfunctions in the communications interface, having a means to detect malfunctions in the central computer, and having a means to send a special synthesized voice message to all handheld radios.

3. The security system described in claim 2, wherein the means to detect malfunctions in the communications interface, to detect malfunctions in the central computer, and to send a special synthesized voice message to all handheld radios is provided by a watchdog timer circuit.

4. The security system described in claim 3, wherein the watchdog timer circuit comprises a first timer chip periodically providing a first triggering signal when the first timer chip counts down;

a speech playback chip sending a pre-scripted audio message when receiving the triggering signal;

a second timer chip being set by the first triggering signal and providing an output signal for a length of time sufficient to allow the speech playback chip to complete sending of its pre-scripted audio message, the output signal conditioning a radio transmitter for transmission of the pre-scripted audio message;

wherein the first timer chip is reset by reception of a periodic reset signal from a microprocessor in the communications interface so that it does not provide the first triggering signal until the microprocessor fails to send the periodic reset signal, thus indicating that the first microprocessor has malfunctioned.

5. The security system described in claim 1, wherein the acknowledgement is an acknowledgement code comprising a sequence of DTMF tones generated by a keypad on the handheld radio, the communications interface having a means of converting the DTMF tones into ASCII codes and sending the ASCII codes to the central computer.

6. The security system described in claim 5, wherein the means of converting the DTMF tones into ASCII codes and sending the ASCII codes to the central computer comprises an MT8870 DTMF decoder integrated circuit in the communications interface, wherein the decoder receives the DTMF tones and provides a binary code; and a microprocessor in the communications interface, wherein the microprocessor receives the binary code, converts the binary code into an ASCII code, and responsively sends a message containing the ASCII code to the central computer.

7. The security system described in claim 1, wherein the acknowledgement is an audible voice signal provided by the recipient having the handheld radio, the audible voice signal sent on the second communications channel, the communications interface having a means of sending the audible voice signal received on the radio receiver to the central computer.

8. The security system described in claim 1, wherein the radio transmitter is a Motorola M1225 Mobile Radio.

9. The security system described in claim 1, wherein the radio receiver is a Motorola M1225 Mobile Radio.

10. The security system described in claim 1, wherein the handheld radio is a Motorola Model SP50 portable radio unit.

11. The security system described in claim 1, further comprising a phone patch.

12. A wireless communications interface apparatus for a security system, the system having a plurality of sensors installed within a facility, each sensor configured to detect a condition and generate in response an alert, the system further having a central computer hosting a database, the central computer asynchronously receiving the alert and responsively providing a communications channel identifier associated with the alert and a synthesized voice message associated with the alert, the synthesized voice message to be received by one or more handheld radios, each handheld radio assigned to and carried by a recipient, each handheld radio configured to receive on a first communications channel and to transmit on a second communications channel, the second and the first communications channels being different communications channels; the wireless communications interface apparatus comprising:

one or more radio transmitters, each radio transmitter capable of selectively transmitting on a plurality of first communications channels, each first communications channel assigned to only one radio transmitter;

a single radio receiver receiving transmissions on the second communications channel, wherein the second communications channel is common to all handheld radios; and a communications interface receiving from the central computer both the communications channel identifier and the synthesized voice message, the communications interface selecting a communications channel identified by the communications channel identifier, the communications interface configuring the radio transmitter associated with the selected first communications channel for transmission on the selected first communications channel, the communications interface transmitting on the selected first communications channel the synthesized voice message, the communications interface detecting an acknowledgment received on the radio receiver, the communications interface sending the acknowledgement to the central computer.

13. The wireless communications interface apparatus described in claim 12, the communications interface detecting a malfunction in the communications interface.

14. The wireless communications interface apparatus described in claim 12, the communications interface additionally detecting a malfunction in the central computer, wherein the malfunction is a failure to respond to a signal sent by the communications interface to the central computer.

15. The wireless communications interface apparatus described in claim 14, the communications interface sending a special synthesized voice message to all handheld radios in response to the malfunction.

16. The wireless communications interface apparatus described in claim 14, the communications interface having a watchdog timer circuit.

17. The wireless communications interface apparatus described in claim 14, wherein the watchdog timer circuit comprises a first timer periodically providing a first triggering signal when the first timer counts down;

a speech playback means sending a pre-scripted audio message when receiving the triggering signal;

a second timer receiving the first triggering signal and responsively providing an output signal for a length of time sufficient to allow the speech playback means to send the pre-scripted audio message, the output signal conditioning a selected radio transmitter for transmission of the pre-scripted audio message;

wherein the first timer is reset by reception of a periodic reset signal from a processor in the communications interface so that the first timer does not provide the first triggering signal until the processor fails to send the periodic reset signal.

18. The wireless communications interface apparatus described in claim 12, wherein the acknowledgement is an acknowledgement code comprising a sequence of DTMF tones generated by a keypad on the handheld radio.

19. The wireless communications interface apparatus described in claim 18, the communications interface having a means to convert the DTMF tones into ASCII codes and send the ASCII codes to the central computer.

20. The wireless communications interface apparatus described in claim 19, wherein the means of converting the DTMF tones into ASCII codes and sending the ASCII codes to the central computer comprises a DTMF decoder integrated circuit in the communications interface, wherein the decoder receives the DTMF tones and provides a binary code; and a processor in the communications interface, wherein the processor receives the binary code, converts the binary code into an ASCII code, and responsively sends a message containing the ASCII code to the central computer.

21. The wireless communications interface apparatus described in claim 12, wherein the radio transmitter is a mobile radio.

22. The wireless communications interface apparatus described in claim 12, further comprising a phone patch.

* * * * *